US006793452B2

(12) United States Patent
Cusack et al.

(10) Patent No.: US 6,793,452 B2
(45) Date of Patent: Sep. 21, 2004

(54) TRUSS STYLE STICK OR BOOM

(75) Inventors: Christopher C. Cusack, Decatur, IL (US); Aaron D. Goodman, Clinton, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 09/929,793

(22) Filed: Aug. 14, 2001

(65) Prior Publication Data

US 2003/0035710 A1 Feb. 20, 2003

(51) Int. Cl.[7] ..... E02F 9/14
(52) U.S. Cl. ..... 414/694; 414/722
(58) Field of Search ..... 414/694, 722

(56) References Cited

U.S. PATENT DOCUMENTS

| | | | | |
|---|---|---|---|---|
| 1,769,269 A | | 1/1930 | Norris | |
| D172,731 S | | 7/1954 | Wagner et al. | |
| 2,846,094 A | | 8/1958 | Pilch | |
| 2,878,951 A | | 3/1959 | Pilch | |
| 2,890,805 A | | 6/1959 | Pilch | |
| 3,155,251 A | | 11/1964 | Williamson | |
| 3,198,359 A | | 8/1965 | Lull | |
| 3,208,611 A | | 9/1965 | Robnett | |
| 3,220,578 A | | 11/1965 | Pilch | |
| 3,259,259 A | | 7/1966 | Metailler | |
| 3,501,034 A | | 3/1970 | Baron | |
| 3,653,131 A | * | 4/1972 | Pilch | 414/694 X |
| 4,044,610 A | * | 8/1977 | Oldaeus et al. | 414/694 X |
| 4,142,308 A | | 3/1979 | Brandtjen | |
| 4,316,697 A | | 2/1982 | Yokoyama | |
| 4,389,152 A | | 6/1983 | Palm | |
| 4,798,512 A | | 1/1989 | Intveld | |
| 5,111,578 A | * | 5/1992 | Ball et al. | 414/722 |
| 5,245,770 A | | 9/1993 | Ko et al. | |
| 5,316,709 A | | 5/1994 | Ko et al. | |
| 5,711,096 A | * | 1/1998 | Kobayashi et al. | 414/694 X |
| 6,158,949 A | | 12/2000 | Walth et al. | |

* cited by examiner

*Primary Examiner*—Donald W. Underwood
(74) *Attorney, Agent, or Firm*—Thomas L Derry; W Bryan McPherson

(57) ABSTRACT

A stick or boom for a work machine. The stick or boom has a box portion including a first and second end and a first and second pivot point position at respective ends. A truss portion having an offset pivot point is attached to said stick or boom.

17 Claims, 2 Drawing Sheets

TRUSS STYLE STICK OR BOOM

TECHNICAL FIELD

This invention relates to a work machine, such as an excavator, backhoe, front shovel or material handler, more particularly to the structure of a stick and/or boom for use with the work machine.

BACKGROUND

In a typical arrangement, the boom and stick have an enclosed, box like configuration. For example, U.S. Pat. No. 3,220,578 discloses a stick having an enclosed, box-like shape.

Structural members for work machines such as backhoes, excavators and front shovels typically include a boom pivotally attached to a machine frame at a first end, a stick pivotally attached to the boom at a second end and a bucket or material handling device further attached to the stick. Drive mechanisms, often hydraulic cylinders, are coupled to the machine in manner that moves the boom relative to the machine frame, the stick relative to the boom and the material handler relative to the stick.

In order to achieve the desired movement of structural members, sticks and booms are typically have three pivot (attachment) points. Two of the three pivot points are typically disposed at the first and second end, respectively, of the boom or stick. The first and second pivot points typically define a first longitudinal axis. The third pivot point is typically disposed at a predetermined distance from the first longitudinal axis. A second axis can be defined by extending a line from the first pivot point to the offset pivot point and a third axis can be defined by extending a line from the second pivot point to the offset pivot point. The first longitudinal axis, the second axis and the third axis form a triangle.

A problem with the box-like configuration is that such a structure is high in cost to manufacture and heavy in weight. When the boom or stick is unnecessarily heavy, the amount of material such as dirt or rock that can be carried by a bucket is reduced, thus requiring extra bucket loads to fill a truck. The additional weight also induces additional stress into other components of the work machine; this may adversely effect the life of the work machine. The power requirements to lift or move the additional weight increases the engine and related component size, resulting in increased machine cost. Unnecessary weight, generally, reduces efficiency and increases operating costs of the machine.

The present invention is directed toward overcoming one or more of the problems set forth above.

SUMMARY OF THE INVENTION

In an embodiment of the present invention, a work machine having at least one of a boom and a stick. A material-handling device is attached to the boom or stick. The boom or stick being constructed of a box portion and an attached truss portion.

In another embodiment of the present invention, a structural member for a work machine is disclosed. The structural member has a first end and a second end, a first pivot point disposed adjacent the first end and a second pivot point is disposed adjacent the second end. The structural member comprises an offset pivot point having a plurality of longitudinal members extending to the box section, forming a rigid structure.

In yet another embodiment of the present invention, a method of reducing the weight in one of a stick and boom of a work machine. The method includes constructing a box portion having a first pivot point, a second pivot point and a first longitudinal axis extending therethrough. A truss portion is constructed having a plurality of longitudinal members intersecting a third pivot point. Attaching the truss section to the box section completes the stick or boom.

DETAILED DESCRIPTION

Figure 1:
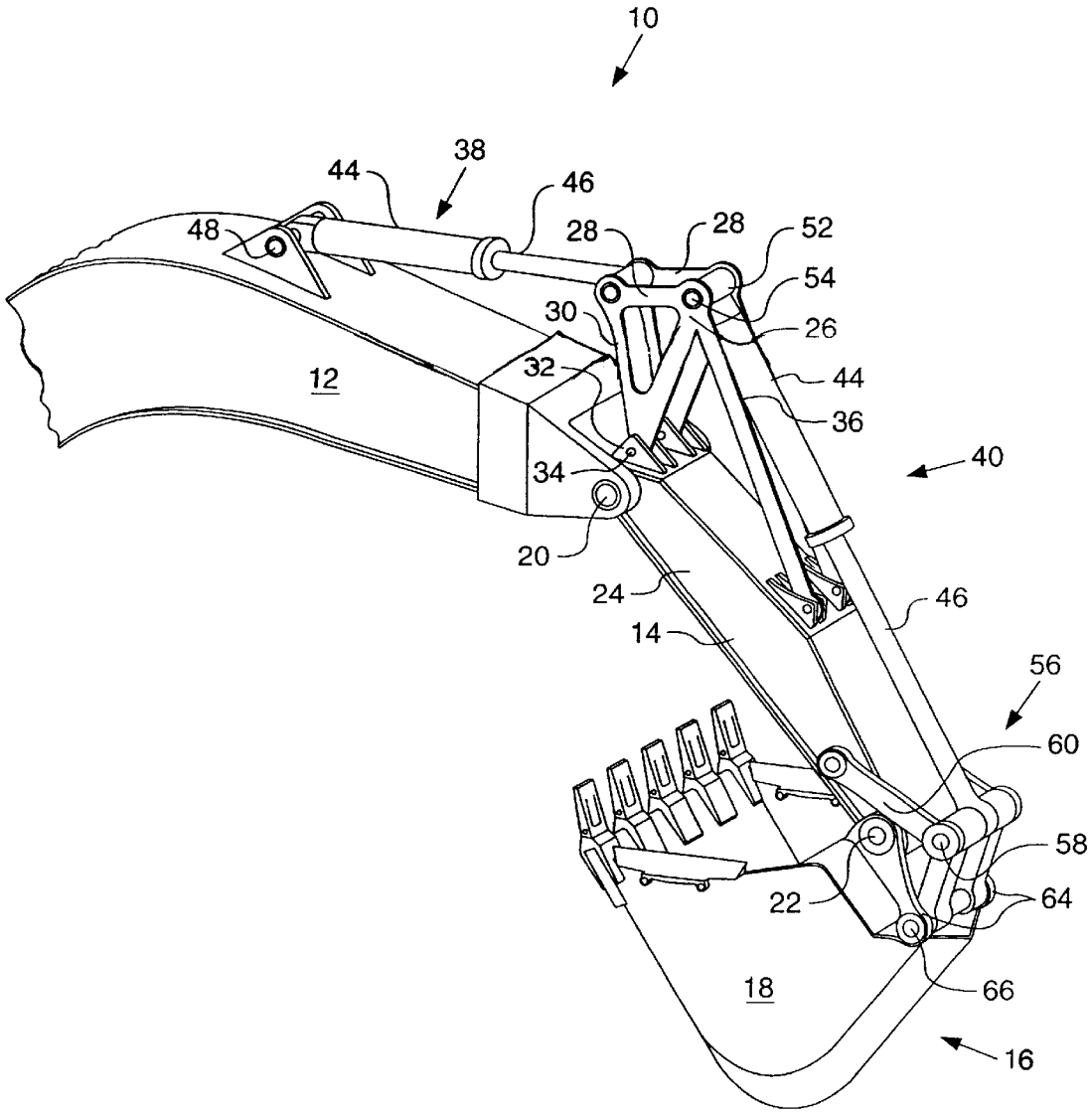
FIG. 1 is a perspective view of a portion of a work machine, according to one aspect of the present invention.

Referring to FIG. 1, a work machine 10 includes a boom 12, a stick 14 and a material-handling device 16. In this application an excavator is used to define the work machine 10, the material handling device 16 is a bucket 18. However, the invention may be applied to other types of work machines, such as a wheel loader, backhoe, or telescopic material handler. In the case of a wheel loader, one material-handling device could have a mechanism for grasping the material, such as a grapple. The stick 14 is pivotally connected to the boom 12 at stick pivot point 20 and the bucket 18 is pivotally connected the stick 14 at bucket pivot point 22.

According to one aspect of the present invention, the stick 14 includes a first portion (box portion) 24 that is constructed from a plurality of plate sections attached to one another to create a box or rectangular cross-section. The box portion 24 is substantially enclosed around its periphery, as illustrated in FIG. 1. According to this embodiment, the truss portion 26 includes a pair of triangular truss members 28 that are spaced apart from each other and interconnected by cross members 30. The truss portion 26 is pivotally connected to the box portion 24 at base pivot point 32 so that it is free to rotate with respect to the box portion 24. More specifically, a base plate 34 is secured to the box portion 24 and the truss portion 26 is pivotally attached to the base plate 34 at base pivot point 32. However, it is important that the truss portion 26 be generally fixed in relation to the box portion 24. Therefore, a pair of support members 36 extend from the end of the truss portion 26 to the box portion 24 to prevent the truss portion 26 from rotating with respect to the box portion 24 about pivot point 32. As a result of this arrangement, the truss portion 26 is able to withstand forces created during operation of the machine. However, it should be understood that the invention is not limited to having the truss portion 26 pivotally secured to the base plate 34. One suitable alternative would be to have the truss portion 26 solidly attached (e.g., integrally attached) to the box portion 24. Another alternative is to mount the truss portion 26 using the current stick 14 to boom 12 connecting pin 20.

It should be noted that the base plate 34 may either be integrally secured to the box portion 24 or, alternatively, the base plate 34 may be removably attached using bolts, screws, or the like. Further, it should be understood that this is just one example of a suitable truss portion 26 and the invention is not limited to any particular truss design.

A first drive mechanism 38 is provided for pivoting the stick 14 with respect to the boom 12. A second drive mechanism 40 is provided for pivoting the bucket 18 or material handling device 16 with respect to the stick 14. A third drive mechanism (not shown) is provided for pivoting the boom 12 with respect to a machine frame. In this application, a typical drive mechanism includes a hydraulic cylinder 44 and rod 46. A number of drive mechanisms may be used in place of the cylinder 44 and rod 46, including cables and pulleys.

With respect to the first drive mechanism 38, the base end of the cylinder 44 is pivotally connected to the boom 12 at pivot point 48 and distal end of the rod 46 is pivotally attached to the truss portion 26 at a first truss pivot point 50. With respect to the second drive mechanism 40, a base end 52 of the cylinder 44 is pivotally connected to the truss portion 26 at a second truss pivot 54 and the distal end of the rod 46 is pivotally connected to a linkage 56 at a linkage pivot point 58. The linkage 56 includes a first pair of link members 60 which are pivotally connected at one end to the distal end of the rod 46 at the first linkage pivot point 58 and at the other end to the stick 14 at a second linkage pivot point 62. The linkage further includes a second pair of link members 64 which are connected at one end to the first linkage pivot point 58 and at the opposite end to a back of the bucket 18 at a third linkage pivot point 66. The linkage and drive mechanisms are conventional and the invention is not intended to be limited to any particular linkage or drive mechanism.

Figure 2:
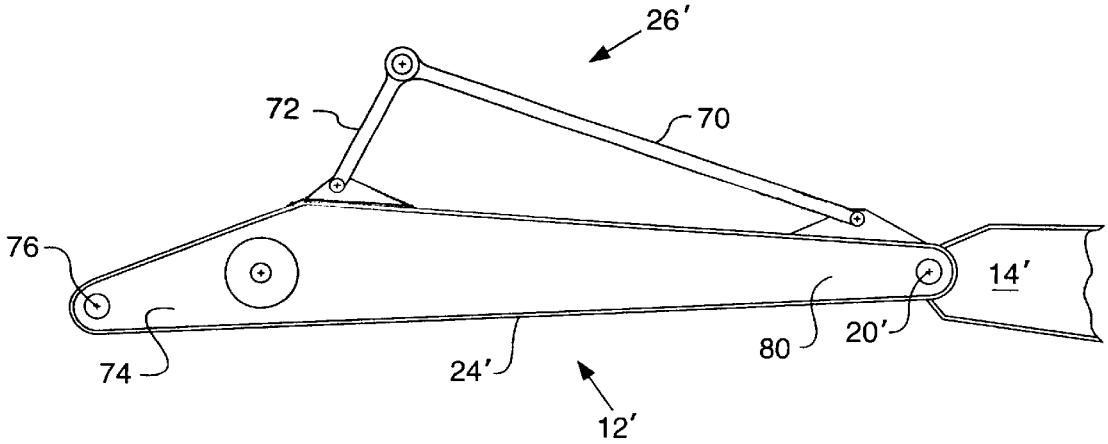
FIG. 2 is a side view of a boom of a work machine, according to another aspect of the present invention.

According to another aspect of the invention, the boom 12' may included a truss portion 26' in combination with a box portion 24'. More specifically and with reference to FIG. 2, the boom 12' may include the first portion (box portion) 24' and the second portion (truss portion) 26'. The truss portion 26' includes a first pair of truss members 70, 72 which, together with the box portion 24' forms a triangle. Although not shown, a second pair of truss members may be laterally spaced from the first pair of truss members 70, 72, and suitably interconnected by one or more connecting members, as with the truss portion 22 discussed in regard to the stick 14.

The boom 12' is pivotally attached to the machine 10 and the stick 14' is pivotally attached to the boom 12'. More specifically, a first end 74 of the boom 12 includes a boom pivot point 76 for pivotally attaching the boom 12 to a machine frame 78. Correspondingly, a second end 80 of the boom 12 includes the stick pivot point 18' for pivotally attaching the stick 14 to the boom 12. The truss portion 16' includes the pivot point 48' for attaching the first drive mechanism 36'. The first drive mechanism 36' further attaches to a stick.

Industrial Applicability

In operation, the apparatus of the present invention operates in a conventional manner. For example, the first drive mechanism 38 is operable to pivot to stick 14 with respect to the boom 12. The second drive mechanism 40 is operable to pivot the bucket 18 or material handling device 16 with respect to the stick 14 and the third drive mechanism 42 is operable to pivot the boom with respect to the machine frame (not shown).

The present invention provides a stick 14 and boom 12 that is constructed with less steel, therefore reducing the weight and cost of the structure. The reduced structure weight additionally increases the amount of material that the bucket 18 can lift. Fuel efficiency is also improved due to the reduced weight, because the machine is not required to move the excess weight. In some cases, the amount of weight reduction of the structure may increase payload capacity enough to reduce the horsepower requirement for the engine, allowing the use of a lower cost engine. In other cases the increase payload capacity may permit use of a smaller machine, saving the customer some capital expense.

In addition, it is possible to have a variety of truss designs adapted to fit different machine configurations. A single machine may be reconfigured for different functions by changing the material handling device 20, the stick 14 or the boom 16.

It should be understood that while one embodiment is described in connection with an excavator, the present invention if readily adapted to provide similar functions for other work machines. Other aspects, objects and advantages of the present invention can be obtained from a study of the drawings, the disclosure and the appended claims.

What is claimed is:

1. A work machine having a frame, at least one of a boom and a stick, said boom pivotally attached to said frame, and said stick pivotally attached to said boom, and a material handling device connected to one if said stick and said boom, said work machine comprising:

at least one of said boom and stick having a first pivot point and a second pivot point positioned on a box portion having a box type construction; and an offset pivot portion positioned on a truss portion, said truss portion being attached to said box portion and at least one support member extending from said truss portion to said box portion, wherein said truss portion is rigidly positioned relative to said box portion.

2. The work machine of claim 1, wherein said truss portion forms at least one triangle.

3. The work machine of claim 1, wherein said stick includes said box portion and said truss portion.

4. The work machine of claim 1, including:

a first drive mechanism interconnecting said boom and said stick for pivotally moving said stick with respect to said boom; and a second drive mechanism interconnecting said stick and said material handling device for pivotally moving said material handling device with respect to said stick.

5. The work machine of claim 4, wherein said first drive mechanism has a first end connected to said boom and a second end connected to said truss portion of said stick and wherein said second drive mechanism includes a first end connected to said truss portion of said stick and a second end connected to said bucket.

6. The work machine of claim 5, wherein said second end of said first drive mechanism and said first end of said second drive mechanism are pivotally connected to said truss portion.

7. The work machine of claim 6, wherein said first and second drive mechanisms includes a cylinder having a rod that is hydraulically driven.

8. The work machine of claim 1, wherein said truss portion is pivotally connected to said box portion and has a support member fixedly connecting said truss portion to said box portion.

9. The work machine of claim 1, wherein said truss portion is removably attached to said box portion.

10. One of a boom or stick for a work machine, said one of boom or stick having a box portion including a first end and a second end, a first pivot point disposed adjacent said first end and a second pivot point disposed adjacent said second end, a structural member comprising:

a truss portion having a offset pivot point;

said truss portion having a plurality of longitudinal truss members extending between said offset pivot and said box portion; and said longitudinal members forming a rigid structure in relation to said box structure.

11. The structural member of claim 10, wherein said structural member is a boom for a work machine.

12. The structural member of claim 10, wherein said structural member is a stick for a work machine.

13. The structural member of claim 10, wherein said truss portion is removably attached to said box section.

14. The structural member of claim 10, wherein said truss portion is integral of said box section.

15. The structural member of claim 10, wherein said truss portion forms a triangular portion.

16. The structural member of claim 10, wherein said plurality of longitudinal truss members comprises a first longitudinal truss member extending between said offset pivot point and a first location adjacent said box portion, and a second longitudinal truss member extending between said offset pivot point and a second location adjacent said box portion.

17. The structural member of claim 16, wherein said plurality of longitudinal truss members further comprises a third longitudinal truss member extending between said offset pivot point and a third location adjacent said box portion, and a fourth longitudinal truss member extending between said offset pivot point and a fourth location adjacent said box portion, said third longitudinal truss member being laterally located to said first truss member, and said fourth longitudinal truss member being laterally located to said second truss member.

* * * * *